US007519191B2

(12) United States Patent
Enomoto et al.

(10) Patent No.: US 7,519,191 B2
(45) Date of Patent: Apr. 14, 2009

(54) LOUDSPEAKER, MANUFACTURING METHOD THEREOF, AND MOBILE TELEPHONE USING THE SAME

(75) Inventors: Mitsutaka Enomoto, Matsusaka (JP); Hiroshi Yano, Tsu (JP); Takeshi Shimokawatoko, Hisai (JP)

(73) Assignee: Matsushita Electric Industrial Co., Ltd. (JP)

( * ) Notice: Subject to any disclaimer, the term of this patent is extended or adjusted under 35 U.S.C. 154(b) by 727 days.

(21) Appl. No.: 10/522,943

(22) PCT Filed: May 27, 2004

(86) PCT No.: PCT/JP2004/007662

§ 371 (c)(1),
(2), (4) Date: Jan. 31, 2005

(87) PCT Pub. No.: WO2004/110097

PCT Pub. Date: Dec. 16, 2004

(65) Prior Publication Data

US 2006/0120551 A1 Jun. 8, 2006

(30) Foreign Application Priority Data

Jun. 6, 2003 (JP) ..... 2003-162048

(51) Int. Cl.
*H04R 25/00* (2006.01)

(52) U.S. Cl. ..... 381/186; 381/401; 381/412; 381/420

(58) Field of Classification Search ..... 381/182, 381/186, 386, 396, 400, 401, 402, 403, 412, 381/420, 421; 340/388.1, 388.2, 407.1; 455/569.1, 455/575.1

See application file for complete search history.

(56) References Cited

U.S. PATENT DOCUMENTS

| | | | | |
|---|---|---|---|---|
| 6,553,125 | B2 * | 4/2003 | Kobayashi et al. | 381/396 |
| 6,741,721 | B2 * | 5/2004 | Fukawatase et al. | 381/401 |
| 2002/0168074 | A1 | 11/2002 | Miyamoto et al. | |
| 2003/0003945 | A1 | 1/2003 | Saiki et al. | |

FOREIGN PATENT DOCUMENTS

| | | | |
|---|---|---|---|
| JP | 2002-335597 | A | 11/2002 |
| JP | 2003-32792 | A | 1/2003 |
| JP | 2003-102092 | A | 4/2003 |
| JP | 2003-111194 | A | 4/2003 |
| KR | 2002-0060012 | A | 7/2002 |

OTHER PUBLICATIONS

Relevant portion of Korean Office Actioin of corresponding Korean Application 10-2005-7000747, (May 9, 2006).

* cited by examiner

*Primary Examiner*—Huyen D Le
(74) *Attorney, Agent, or Firm*—Rossi, Kimms & McDowell, LLP

(57) ABSTRACT

A loudspeaker used mainly for mobile communication equipment such as a mobile telephone and having two loudspeaker parts provided in one frame is provided. In the loudspeaker, a yoke has a groove portion and a second voice coil disposed in this groove portion drives a second diaphragm. Since the groove portion functioning as a magnetic gap is formed by processing the yoke, variation in the magnetic gap, which conventionally occurred at the time of incorporation, is eliminated and accuracy is improved, thus stabilizing the sound pressure frequency property.

10 Claims, 4 Drawing Sheets

LOUDSPEAKER, MANUFACTURING METHOD THEREOF, AND MOBILE TELEPHONE USING THE SAME

This application is a U.S. National Phase Application of PCT International Application PCT/JP2004/007662.

TECHNICAL FIELD

The present invention relates to a loudspeaker used for mobile communication equipment such as a mobile telephone, a method for manufacturing the same and a mobile telephone using the same.

BACKGROUND ART

Although a mobile telephone is small in size, it has a loudspeaker for ringing or amplifying the sound in addition to a receiving loudspeaker. In particular, since there is a limit to miniaturization of small-sized equipment such as folding type equipment, two loudspeaker parts are built in one frame. FIG. 8 is a sectional view showing a conventional loudspeaker of this kind.

Hollow cylindrical frame 1 formed by resin molding has convex part 1A protruding inwardly all around a center part of an inner circumferential surface. Ring-shaped first magnet 2 is bonded to convex portion 1A at its outer circumferential side surface. Cup-shaped yoke 3 made of a magnetic material such as iron is bonded to first magnet 2 at its lower surface of an outer circumference. Columnar second magnet 4 is bonded to a center part of yoke 3. Annular first plate 6 is bonded to a lower surface of first magnet 2, and second plate 5 is bonded to an upper surface of second magnet 4. Annular first magnetic gap 7 is provided between an inner circumference of first plate 6 and the outer circumference of the center part of yoke 3. Annular second magnetic gap 8 is formed between an outer circumference of second plate 5 and an inner circumference of the center part of yoke 3.

In the above-mentioned configuration, first magnet 2, yoke 3, first magnetic gap 7 and first plate 6 form a first magnetic circuit. Furthermore, second magnet 4, second plate 5, second magnetic gap 8 and yoke 3 form a second magnetic circuit.

First diaphragm 9 is placed at a lower side opening of frame 1. Annular first voice coil 10 is bonded to first diaphragm 9 at its lower end and located in first magnetic gap 7 at another end. First protector 10A has a plurality of holes for releasing sound and is bonded to outer circumferences of frame 1 and first diaphragm 9 such that it covers first diaphragm 9. Second diaphragm 11 is bonded to an upper side opening of frame 1. Annular second voice coil 12 is bonded to second diaphragm 11 at its upper end and located in second magnetic gap 8 at another end. Second protector 13 has a plurality of holes for releasing sound and is bonded to outer circumferences of frame 1 and second diaphragm 11 such that it covers second diaphragm 11. Such a loudspeaker is disclosed in, for example, Japanese Patent Unexamined Publication No. 2003-111194.

When a loudspeaker having the above-mentioned configuration including two loudspeaker parts is used for, for example, a mobile telephone, one loudspeaker part is used as a receiver for receiving and another is used for a loudspeaker for notifying incoming of call or a loudspeaker. Furthermore, the loudspeaker can be used as a small-sized stereo loudspeaker by inputting LR signals, respectively.

However, since in the loudspeaker having such a configuration, two magnetic circuits are built in, it is difficult to reduce weight. Also, the configuration is complicated, resulting in increase in the number of components and the man-hour required for assembly. Accordingly, the cost is high. Note here that although there is a loudspeaker having two diaphragms in one magnetic circuit, variation is likely to occur in a sound pressure frequency property. Therefore, strict assembly accuracy is required, and assembly itself is complex

SUMMARY OF THE INVENTION

A loudspeaker of the present invention is a composite type loudspeaker for driving two diaphragms in one magnetic circuit. The loudspeaker includes a hollow frame, a magnet, a yoke, a plate, a first voice coil, a first diaphragm, a second voice coil and a second diaphragm. The frame includes a first opening and a second opening facing the first opening. The magnet is provided inside the frame, and has a first pole and a second pole facing the first opening and the second opening, respectively. The plate made of a magnetic material is provided in contact with the first pole of the magnet. The yoke made of a magnetic material is provided in contact with the second pole of the magnet, forms magnetic flux flow between the first pole and the second pole and has a groove portion on a surface facing the second opening. The first voice coil has a first end located in a magnetic gap provided between the yoke and the plate. The first diaphragm is bonded to a second end of the first voice coil and bonded to the first opening of the frame at its outer periphery. The second voice coil has a first end located in the groove portion. The second diaphragm is bonded to a second end of the second voice coil and bonded to the second opening of the frame at its outer periphery.

In a method for manufacturing a loudspeaker of the present invention, a yoke is provided with a groove portion.

A mobile telephone of the present invention uses a second loudspeaker part including the second diaphragm of the above-mentioned loudspeaker as a receiver for releasing sound from another end of the telephone.

DETAILED DESCRIPTION OF PREFERRED EMBODIMENT

Figure 1:
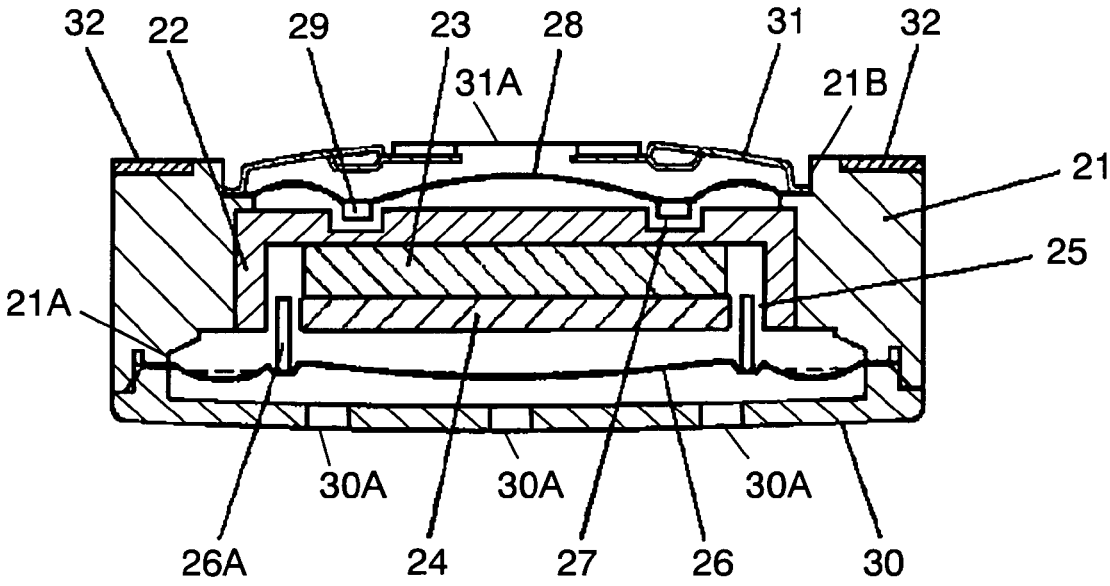
FIG. 1 is a side sectional view showing a loudspeaker according to an embodiment of the present invention.

FIG. 1 is a sectional view showing a loudspeaker according to an embodiment of the present invention. Hollow cylindrical frame 21 is formed by resin molding. Yoke 22 has a U-shaped cross section and is made of iron that is a magnetic metal. An outer wall portion of yoke 22 is integrated with frame 21 by insert molding and supported by an inner wall of frame 21. Columnar magnet 23 having a first pole and a second pole (north pole and south pole) at lower and upper sides is provided inside yoke 22 with the second pole attached to a center of a top surface of yoke 22. Plate 24 is also made of a magnetic material and is attached to the lower surface, that is, the first pole of magnet 23. Both poles of magnet 23 face first opening 21A and second opening 21B of frame 21, respectively. Between the outer wall of yoke 22 and plate 24, magnetic gap 25 is formed. First diaphragm 26 is attached to first opening 21A of frame 21 at its outer periphery. To the end part, a second end of first voice coil 26A is attached, while a first end thereof is located in magnetic gap 25. Yoke 22 forms magnetic flux flow between the both poles of magnet 23.

Groove portion 27 is provided on a surface facing second opening 21B of yoke 22, and second diaphragm 28 is attached to second opening 21B facing first opening 21A of frame 21 at its outer periphery. To an end of second diaphragm 28, a second end of second voice coil 29 is attached, while first end of second voice coil 29 is located in groove portion 27. Note here that groove portion 27 has a width and a depth appropriately set to generate magnetic saturation by suitably narrowing a magnetic path of yoke 22 that forms a magnetic circuit, and to function as a second magnetic gap. Accordingly, magnetic flux leaking into groove portion 27 that is the second magnetic gap is increased, and an output of sound pressure of the loudspeaker is increased. In the above-mentioned configuration, magnet 23, plate 24, magnetic gap 25, voice coil 26A, yoke 22, and diaphragm 26 form a first loudspeaker part. Furthermore, magnet 23, plate 24, groove portion 27, voice coil 29, yoke 22, and diaphragm 28 form a second loudspeaker part.

First protector 30 provided with a plurality of holes 30A for releasing sound and second protector 31 provided with center hole 31A are respectively attached to first and second openings 21A and 21B of frame 21 such that they cover diaphragm 26 and 28, respectively. Terminal boards 32 are provided at four portions of frame 21 and electrically connected (not shown) to both ends of first voice coil 26A and second voice coil 29, respectively.

Ring-shaped groove portion 27 can be formed extremely easily by casting at the same time yoke 22 is formed. Furthermore, groove portion 27 can be extremely easily formed by forging of sheet-like or hoop-shaped iron material before, after or when yoke 22 is formed. In this way, since groove portion 27 is formed by casting or forging and used as the second magnetic gap, the second magnetic gap can be finished to have a certain shape and size with high accuracy when yoke 22 is formed. Therefore, when the loudspeaker is incorporated, no error in incorporating the magnetic gap occurs.

Furthermore, since yoke 22 and frame 21 are integrated with each other, eccentric error of magnetic gap 25 with respect to frame 21 when the loudspeaker is incorporated is suppressed. Furthermore, incorporating error in the location relation between second voice coil 29 and groove portion 27 that is the second magnetic gap is also suppressed. Accordingly, the sound pressure frequency property of the loudspeaker is stabilized.

In the loudspeaker configured as mentioned above, groove portion 27 provided in yoke 22 functions as the second magnetic gap into which second voice coil 29 is inserted, and two loudspeakers are included.

Figure 2:
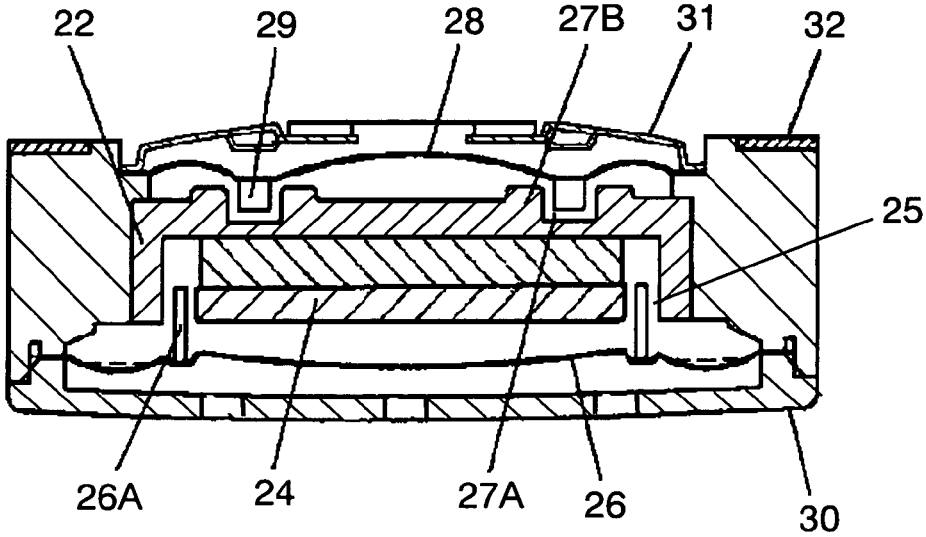
FIGS. 2 and 3 are side sectional views showing modifications of the loudspeaker shown in FIG. 1.

FIG. 2 is a side sectional view showing a modification of the above-mentioned configuration. This configuration is different from the configuration shown in FIG. 1 in groove portion 27A. This configuration includes standing wall (hereinafter, which is referred to as "wall") 27B formed by extending both side walls of groove portion 27A upwardly. By providing wall 27B, the depth of groove portion 27A is increased, as well as leakage flux is more concentrated to improve the magnetic efficiency, and the output of sound pressure of the loudspeaker is increased to improve the sound pressure frequency property.

Note here that in FIG. 2, wall 27B is provided on both sides of groove portion 27A, but it may be provided on only one side if necessary.

Furthermore, when yoke 22 is formed by casting, wall 27B can be formed extremely easily by using a casting mold, and when yoke 22 is formed by forging, wall 27B can be formed extremely easily as a buildup portion when groove portion 27A is formed at the time of forging.

Figure 3:
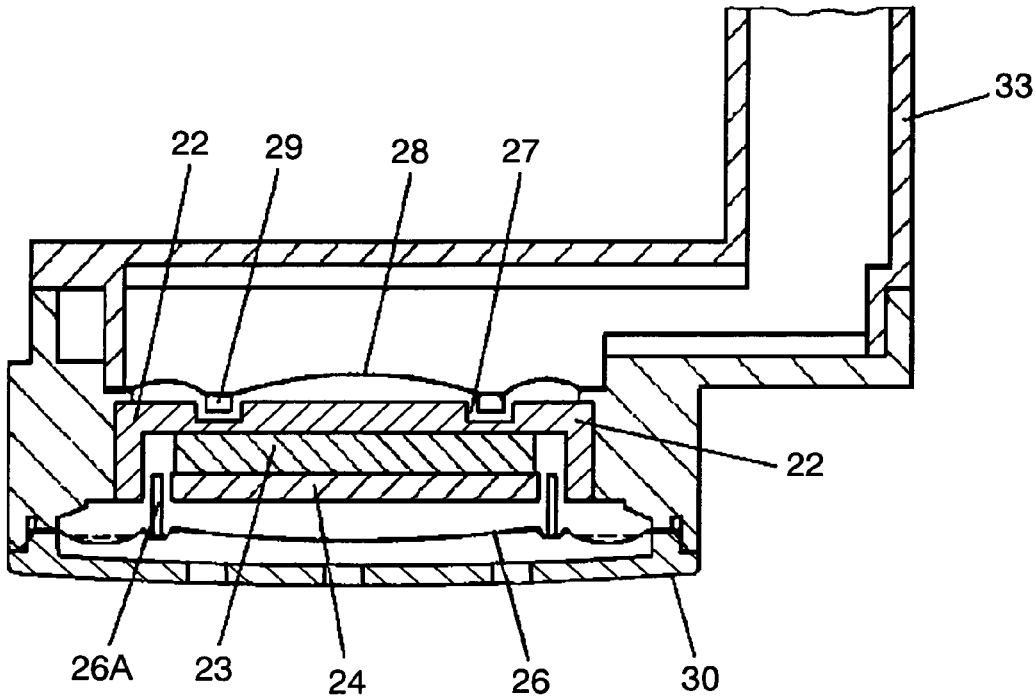

FIG. 3 is also a side sectional view showing a modification of the configuration shown in FIG. 1. This configuration is different from the configuration shown in FIG. 1 in that instead of protector 31, port 33 is provided. With port 33, it is possible to release sound from a certain position of equipment into which this loudspeaker is incorporated.

Figure 4:
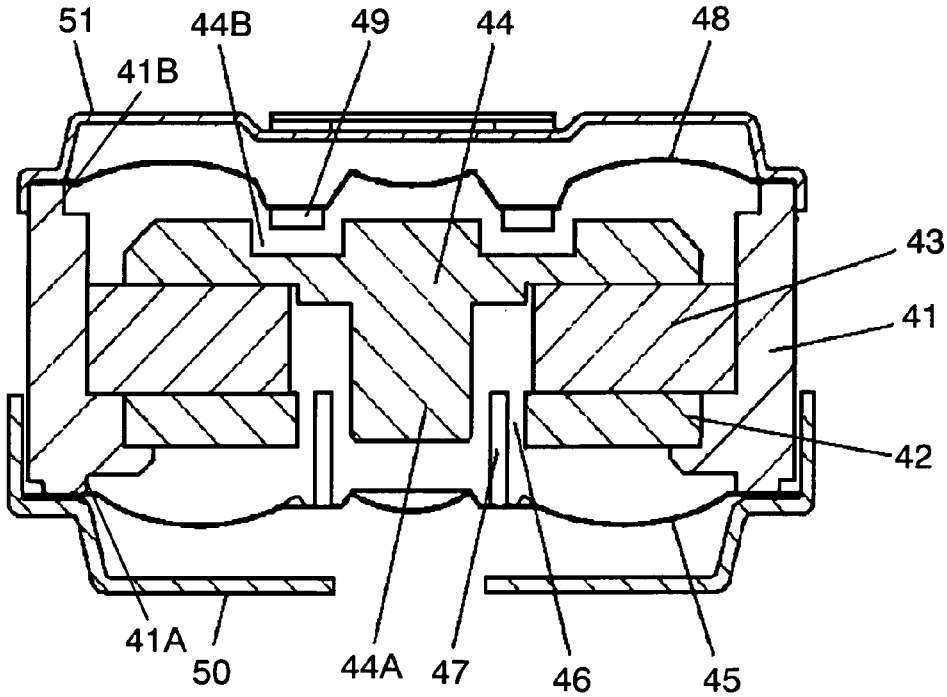
FIG. 4 is a side sectional view showing another loudspeaker according to an embodiment of the present invention.

Then, another configuration of the present invention is described. FIG. 4 is a side sectional view showing a loudspeaker having another configuration according to an embodiment of the present invention. FIGS. 1 to 3 show configurations of an internal magnetic type loudspeaker having columnar magnet 23 in a center part thereof Meanwhile, this configuration shows an external magnetic type loudspeaker using ring-shaped magnet 43.

Frame 41 made of resin has first and second openings 41A and 41B at lower and upper ends and is formed as a hollow frame. Ring-shaped plate 42 is made of a magnetic material and integrated with frame 41 by insert molding. Ring-shaped magnet 43 is attached to plate 42 at its first pole. Both plate 42 and magnet 43 are provided inside frame 41. Both poles of magnet 43 face first opening 41A and second opening 41B of frame 41, respectively. Yoke 44 made of a magnetic material is attached to a second pole of magnet 43 and has center pole 44A located in a through hole in a center portion of ring-shaped magnet 43 and plate 42. Yoke 44 forms magnetic flux flow between the first pole and the second pole of magnet 43.

First diaphragm 45 is attached at its outer circumference such that it covers first opening 41A. A first end of first voice coil 47 is located in magnetic gap 46 between center pole 44A and an inner circumference of plate 42, and a second end thereof is attached to first diaphragm 45. Second diaphragm 48 is attached at its outer circumference such that it covers the second opening 41B. A first end of second voice coil 49 is located in groove portion 44B provided in yoke 44 in an annular shape, and a second end thereof is attached to second diaphragm 48. Protectors 50 and 51 are attached to first and second openings 41A and 41B such that they cover diaphragms 45 and 48, respectively.

In the configuration, magnet 43, plate 42, magnetic gap 46, voice coil 47, yoke 44 and diaphragm 45 form a first loudspeaker part. Furthermore, plate 42, magnet 43, groove portion 44B, voice coil 49, yoke 44 and diaphragm 49 form a second loudspeaker part.

Note here that groove portion 44B can be formed by casting or forging when yoke 44 is formed. As in FIG. 2, groove portion 44B may be provided with a standing wall.

In the loudspeaker formed as mentioned above, groove portion 44B provided in yoke 44 functions as a second magnetic gap for the second loudspeaker part, and second voice coil 49 is inserted therein. Therefore, when yoke 44 is formed, the magnetic gap can be finished to have a certain shape and size with high accuracy. Accordingly, when the loudspeaker is incorporated, no error in incorporating the magnetic gap occurs.

Furthermore, in this configuration, plate 42 is integrated with frame 41 by insert molding. Besides, an outer wall portion of yoke 44 may be integrated with frame 41 by insert molding. In this case, the relation between frame 41 and groove portion 44B provided in yoke 44 is determined by accuracy of a mold. Therefore, the location accuracy of the magnetic gap is more improved and the quality of the loudspeaker is stabilized.

Note here that for yokes 22 and 44 and plates 24 and 42, a magnetic material having high magnetic permeability and low coercive force is used. For example, iron is preferably used. Furthermore, for magnets 23 and 43, a magnet material having a large energy product is used. Ferrite magnets, samarium-cobalt magnets, neodymium base magnets, and the like are preferred. Neodymium base magnets are preferably used because they have a high energy product and are suitable for achieving small size and light weight. If necessary, magnetic materials and magnet materials may be subjected to an anti-rust treatment.

Frames 21 and 41 are formed by using a resin material. As the resin material, thermoplastic resin that does not need hardening treatment is preferred. For example, ABS, PBT, etc. are used. If heat resistance property is required, it is more preferable to use thermoplastic resin having a glass-transition temperature of 100° C. or more. An example thereof may include polyamide (PA) that is nylon resin containing glass, which has high heat resistance property and high rigidity. Furthermore, in order to integrate resin material with a different kind of material such as metal, a resin material is required to have an excellent fluidity inside a mold. In order to improve fluidity, various additives may be used.

Figure 5:
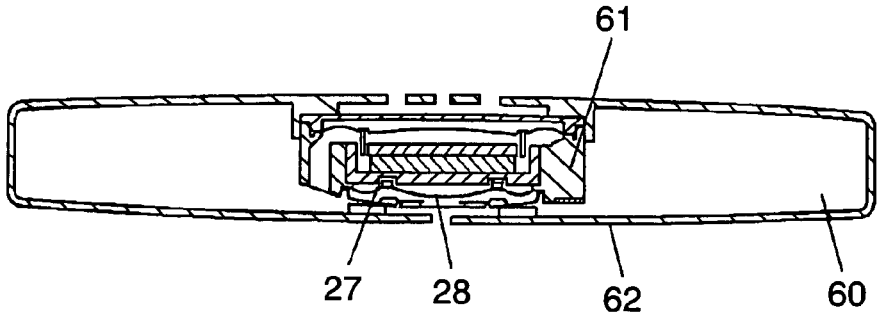
FIG. 5 is a top sectional view showing a mobile telephone according to an embodiment of the present invention.
Figure 6:
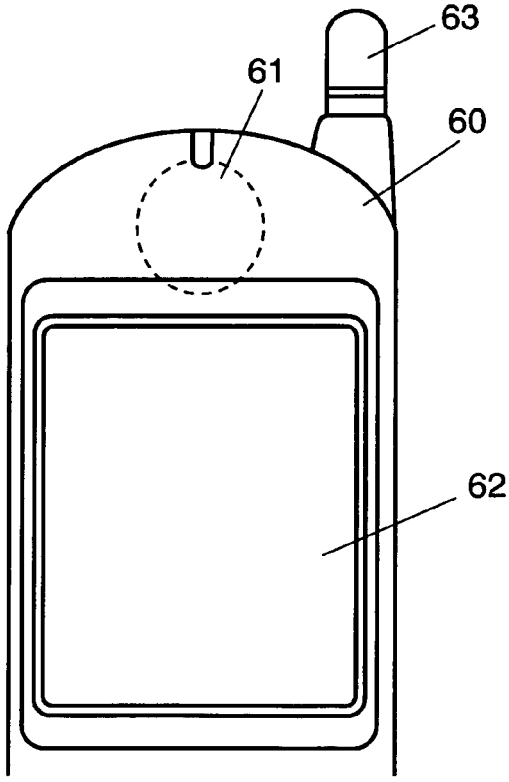
FIG. 6 is a top front view showing the mobile telephone shown in FIG. 5.
Figure 7:
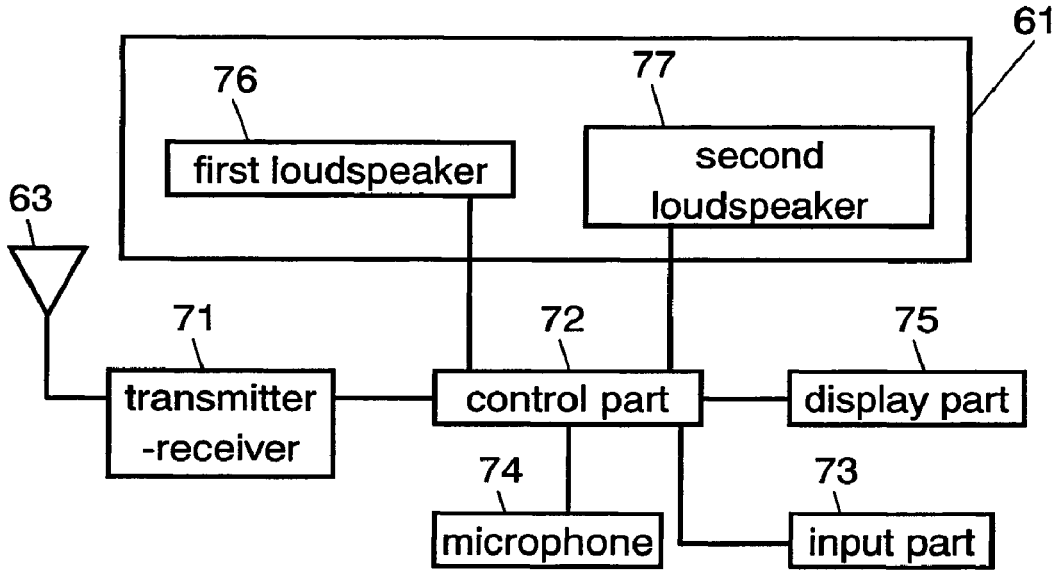
FIG. 7 is a block diagram showing a configuration of a mobile telephone according to an embodiment of the present invention.
Figure 8:
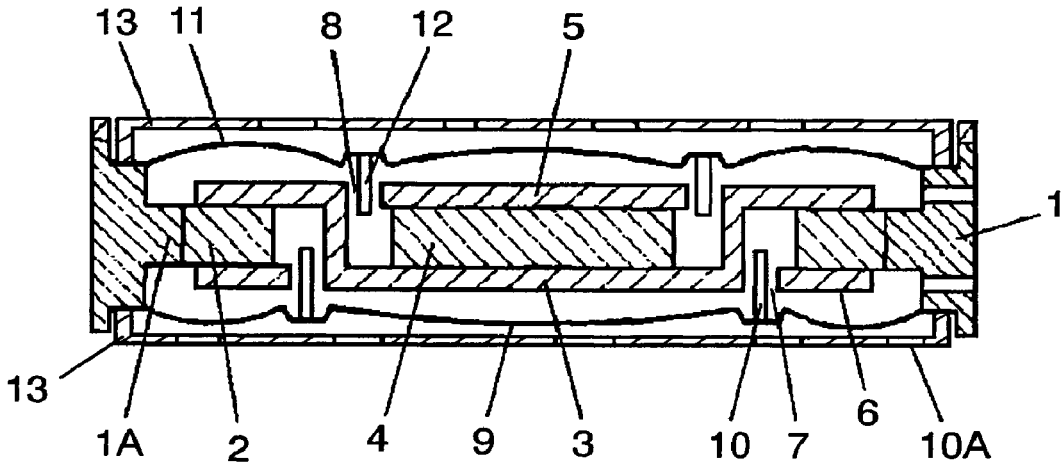
Prior Art FIG. 8
FIG. 8 is a sectional view showing a conventional loudspeaker.

Next, example of mounting the above-described loudspeaker is described with reference to FIGS. 5 to 7. FIG. 5 is a sectional view of a mobile telephone seen from the upper side. FIG. 6 is a front view showing only a display part at the upper side of the mobile telephone shown in FIG. 5. FIG. 7 is a block diagram showing a configuration of the mobile telephone shown in FIG. 5.

When a call is originated, input part 73 receives a telephone number that is information about destination of the call from a user or an originating operation based on search for an installed telephone directory. Control part 72 transmits radio wave including an originating signal from transmitter-receiver 71 to the outside by using antenna 63 based on the signal from input part 73. When another end gets an incoming call answers, a communication line is connected. Microphone 74 inputs a sound from a user and transmits it to control part 72. Control part 72 transmits a signal including sound data from transmitter-receiver 71 to the outside by using antenna 63. Furthermore, a signal including sound data of the other end, which are received by transmitter-receiver 71, is output from second loudspeaker part 77 as a sound by control part 72. Display part 75 displays a telephone number input from input part 73 by a user or search content of telephone directory.

When a call is incoming, transmitter-receiver 71 that receives incoming signal via antenna 63 transmits the signal to control part 72. Control part 72 releases ringtone by first diaphragm 26 of first loudspeaker part 76. At the same time, incoming number etc. may be displayed on display part 75. Input part 73 receives incoming operation by a user and control part 72 transmits a signal of incoming operation from transmitter-receiver 71. Thus, the communication line is connected. Note here that in a case where transmitter-receiver 71 transmits/receives a digital signal, control part 72 functions also as an encoder and a decoder.

In mobile telephone 60 in which loudspeaker 61 shown in FIG. 1 is incorporated, second diaphragm 28 of second loudspeaker part 77 is provided at the side of display surface (receiving surface) 62. With such a configuration, second diaphragm 28 is used as a receiving loudspeaker that does not require a large sound pressure output as a loudspeaker using leakage flux in groove portion 27. Furthermore, in loudspeaker 61 having this configuration, as mentioned above, location accuracy of the magnetic gap is improved. Therefore, incorporating error is suppressed, and variation in sound pressure output is suppressed. Equipment having small variation, for listener, in quality of sound pressure output by the mounted loudspeaker is provided. Furthermore, for example, the reduction of magnets to be used contributes to lightening the weight of the equipment. Instead of the loudspeaker shown in FIG. 1, loudspeakers shown in FIGS. 2 and 4 may be used. In a case where the loudspeaker shown in FIG. 4 is used, second diaphragm 48 is provided at the side of display surface 62.

Note here that this embodiment is described assuming that a loudspeaker has a columnar shape. In addition to this, in accordance with the necessity of mounted equipment etc., a loudspeaker may be formed to have an appearance of a rectangular parallelepiped, or an oval, or an elliptical shape. An inside magnetic circuit may be formed in an oval or an elliptical shape other than a circular shape if necessary. Furthermore, the groove portion is not limited to a circular shape and it may be changed to an oval, or an elliptical, a racetrack shape, etc. in accordance with the shape of the magnetic circuit.

INDUSTRIAL APPLICABILITY

In the loudspeaker of the present invention, a groove portion provided in a yoke is used as a magnetic gap. Consequently, incorporating error occurring when a loudspeaker is incorporated is suppressed and variation is eliminated, and thus a loudspeaker with stable quality can be achieved.

The invention claimed is:

1. A loudspeaker, comprising:

a hollow frame provided with a first opening and a second opening facing the first opening;

a magnet provided inside the frame and having a first pole and a second pole facing the first opening and the second opening, respectively;

a plate made of a magnetic material, which is provided in contact with the first pole of the magnet;

a yoke made of a magnetic material, which is provided in contact with the second pole of the magnet, forms magnetic flux flow between the first pole and the second pole and has a groove portion on a surface facing the second opening;

a first voice coil having a first end located in a magnetic gap provided between the plate and the yoke, a first diaphragm bonded to a second end of the first voice coil and bounded to the first opening of the frame at is outer periphery;

a second voice coil having a first end located in the groove portion; and a second diaphragm bonded to a second end of the second voice coil and bonded to the second opening of the frame at its outer periphery.

2. The loudspeaker according to claim 1, wherein the yoke has a U-shaped cross section and has an outer wall portion supported by an inner wall of the frame, the magnet is provided inside the yoke, and the magnetic gap is provided between the outer wall portion of the yoke and the plate.

3. The loudspeaker according to claim 1, wherein the magnet and the plate are provided with a through hole in a center part thereof, the yoke has a center pole located in the through hole of the magnet and the plate, and the magnetic gap is provided between the center pole of the yoke and the plate.

4. The loudspeaker according to claim 1, wherein the groove portion has a width and a depth to allow a magnetic pathway of a magnetic circuit, which is formed of the magnet, the yoke and the magnetic gap and the plate, to be magnetically saturated at a location of the groove portion.

5. The loudspeaker according to claim 1, wherein the yoke has a standing wall provided at at least one side of the both sides of the groove.

6. The loudspeaker according to claim 1, wherein the frame and the yoke are integrated with each other.

7. A mobile telephone, comprising:

a loudspeaker including: a hollow frame provided with a first opening and a second opening facing the first opening, a magnet provided inside the frame and having a first pole and a second pole facing the first opening and the second opening, respectively, a plate made of a magnetic material, which is provided in contact with the first pole of the magnet, a yoke made of a magnetic material, which is provided in contact with the second pole of the magnet, forms magnetic flux flow between the first pole and the second pole and has a groove portion on a surface facing the second opening, a first voice coil having a first end located in a magnetic gap provided between the plate and the yoke, a first diaphragm bonded to a second end of the first voice coil and bounded to the first opening of the frame at is outer periphery, a second voice coil having a first end located in the groove portion, and a second diaphragm bonded to a second end of the second voice coil and bonded to the second opening of the frame at its outer periphery;

a transmitter-receiver for transmitting/receiving an originating signal, an incoming signal and a signal including sound data to/from an outside;

a control part releasing ringtone from the first diaphragm of the loudspeaker based on the incoming signal received via the transmitter-receiver, and releasing ringtone from the second diaphragm of the loudspeaker based on the signal including sound data received via the transmitter/receiver;

a microphone for inputting a sound signal transmitted to the control part; and an input part for receiving input of information about originating and incoming, and transmitting the information to the control part.

8. A method for manufacturing a loudspeaker comprising:

disposing a magnet inside a hollow frame, the frame being provided with a first opening and a second opening facing the first opening, the magnet having a first pole and a second pole facing the first opening and the second opening, respectively;

bonding a yoke provided with a groove portion to the magnet on the second pole so that the groove portion faces the second opening;

bonding the magnet to a plate on the first pole, the plate being made of a magnetic material;

disposing a first end of a first voice coil in a magnetic gap provided between the plate and the yoke;

bonding a second end of the first voice coil to a first diaphragm;

disposing a first end of a second voice coil in the groove portion;

bonding a second end of the second voice coil to a second diaphragm;

bonding an outer periphery of the first diaphragm to the frame at the first opening; and bonding an outer periphery of the second diaphragm to the frame at the second opening;

wherein the groove portion is formed by forging at a time when, before or after the yoke is formed.

9. The method for manufacturing a loudspeaker according to claim 8, wherein the groove portion is formed by casting when the yoke is formed.

10. The method for manufacturing a loudspeaker according to claim 8, further comprising integrating the frame with the yoke by insert molding an outer wall of the yoke into the frame.

* * * * *